US005626498A

United States Patent [19]

Ohai et al.

[11] Patent Number: 5,626,498

[45] Date of Patent: May 6, 1997

[54] LAMP SOCKET ASSEMBLY

[76] Inventors: Reynolds K. Ohai; Jeffrey L. Ohai, both of 8135 Pinositas Rd., Whittier, Calif. 90605

[21] Appl. No.: 319,922

[22] Filed: Oct. 7, 1994

[51] Int. Cl.[6] ..... H01R 33/05

[52] U.S. Cl. ..... 439/703

[58] Field of Search ..... 439/702, 703, 439/704, 705, 706, 605, 611, 615, 613, 699.2, 802

[56] References Cited

U.S. PATENT DOCUMENTS 1,046,431 12/1912 Benjamin ..... 439/703

1,251,739 1/1918 Benjamin ..... 439/705

4,854,896 8/1989 Warshawsky ..... 439/703

*Primary Examiner*—P. Austin Bradley

*Assistant Examiner*—Yong Kim

*Attorney, Agent, or Firm*—Edgar W. Averill, Jr.

[57] ABSTRACT

A lamp socket assembly of the type having an insulative husk. A cap is affixed to the top of the insulative husk and the cap has a groove that matches with a bump on the cover member so that the cap and the cover member do not turn with respect to one another. In this way a light bulb may be tightened without turning the husk within the cover member.

9 Claims, 3 Drawing Sheets

LAMP SOCKET ASSEMBLY

BACKGROUND OF THE INVENTION

The field of the invention is lamp socket assemblies and the invention relates more particularly to socket assemblies which have a cup or cover which extends downwardly over the socket or over the socket and bulb.

A problem exists for lamp assemblies where a heat lamp is pointed downwardly, for instance as in a restaurant to keep food warm. Because the heat lamp gets very hot and of course, cools off when it is turned off, the socket assembly is subjected to continuous heating and cooling which often results in a loosening of the assembly stem which is screwed into the cap of the light socket fixture. While this unscrewing is prevented in most lamp assemblies by a set screw which is tightened against the threads of the stem, a set screw is not available in many locations where a cup or reflective shield covers the set screw. What occasionally happens is that the continued heating and cooling of the socket causes the stem to become completely unscrewed from the cap and the lamp bulb is supported only by the electrical leads. Then when someone tries to tighten the bulb, a highly unsafe condition occurs.

SUMMARY OF THE INVENTION

It is an object of the present invention to provide a device which will permit the tightening of a cup or reflective shield onto a stem.

The present invention is for a lamp socket assembly of the type having an insulative husk with a cylindrical outer surface, a top surface and an internal conductive lamp holding shell. Two leads are connected electrically to the lamp holding shell and extend upwardly from the top surface of the husk. A cap is affixed to the top of the husk and has an indexing surface irregularity on the upper surface thereof. This irregularity surrounds a threaded central passageway for the passage of the electrical leads. A cover member, including a cap portion, has a matching indexing surface irregularity to that of the cap. The cover member extends downwardly over the husk and also has a central opening for the passage of a stem through which the electrical leads pass. A stem has a hollow portion and a threaded lower end which is threaded into the cap and supports the cover member with an outwardly extending flange or a nut above the threaded portion of the stem. By tightening the stem onto the cover member, the indexing surface irregularity on the cap is matched against the indexing surface irregularity on the cover member and the tightening the two parts to move together. Thus, when the two parts get a little loose, one merely holds the stem and cover member and tightens one with respect to the other which also causes the cap to turn, thereby tightening the stem into the cap.

DESCRIPTION OF THE PREFERRED EMBODIMENTS

Figure 1:
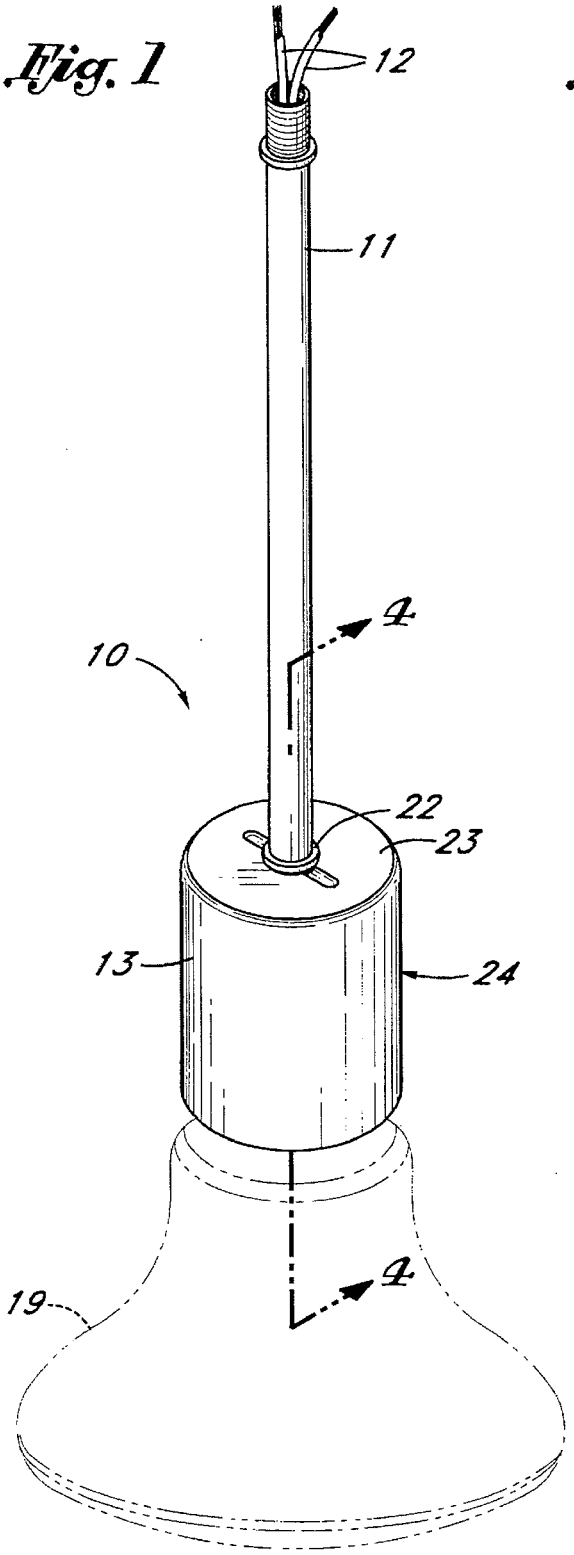
FIG. 1 is a perspective view showing a stem, secured against a cup which surrounds a husk whose internal conductive lamp holding shell holds a lamp shown in phantom view.
Figure 2:
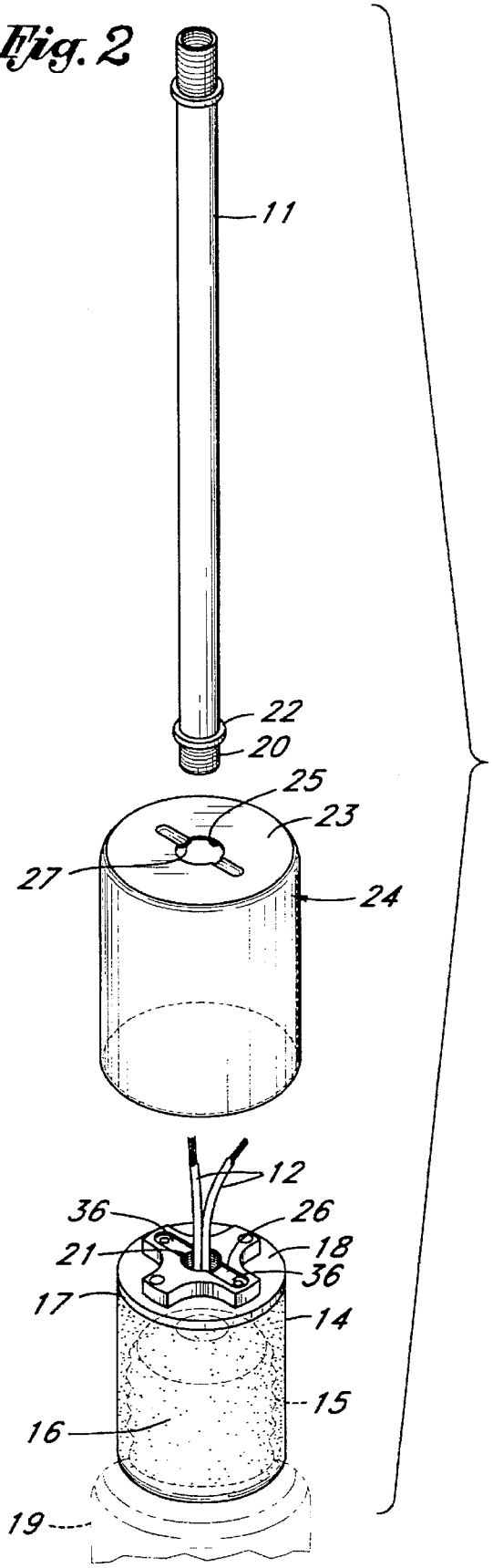
FIG. 2 is an exploded perspective view of the assembly of FIG. 1 also showing the husk and cap.
Figure 4:
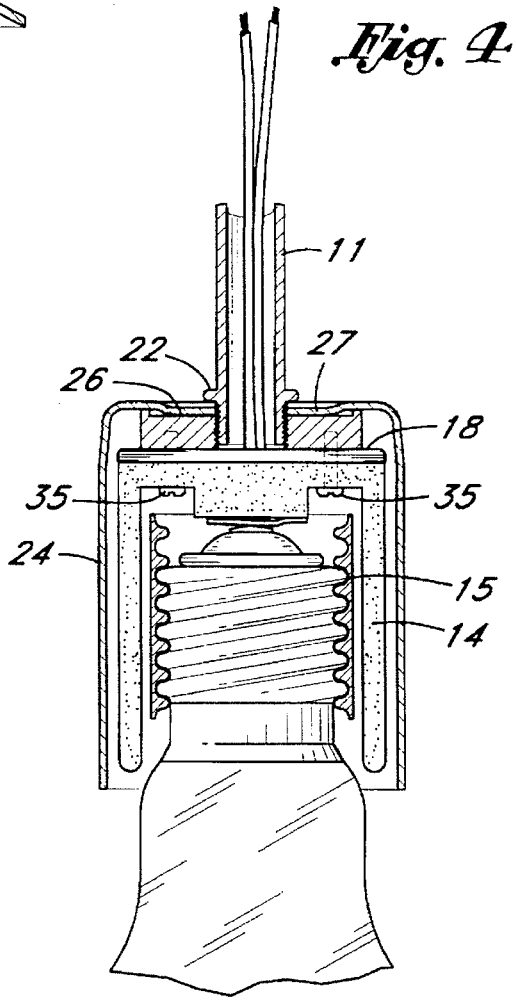
FIG. 4 is a cross sectional view of the assembly of the present invention.

A portion of the lamp socket assembly of the present invention is shown in FIG. 1 and indicated generally by reference character 10. Lamp socket assembly 10 includes a stem 11 through which a pair of electrical leads 12 pass. A cup 13 surrounds an insulative husk 14 shown in FIG. 2. Insulative husk 14 in turn supports an internal conductive lamp holding shell 15 in a conventional manner. Husk 14 has a cylindrical outer surface 16 and a top surface 17. A cap 18 is screwed to husk 14 by a pair of screws directed upwardly into cap 18 from below the undersurface of the top of husk 14 in a relatively conventional manner. A lamp 19 is shown in phantom view in FIGS. 1 and 2 and it is screwed into holding shell 15 in a conventional manner. The assembly shown in FIG. 1 is not uncommon in restaurants where lamp 19 is a heat lamp. The threaded end 20 of stem 11 is screwed into the threaded central passageway 21 in cap 18. Flange 22 abuts the cap portion 23 of cover member 24. Cover member 24 of FIGS. 1, 2 and 4 is shown as a cup, but it could, of course, be a large reflective cover member or other desired ornamental shape. Cup 24 has a central opening 25 through which the threaded end 20 of stem 11 passes. The electrical leads 12 also extend upwardly through cap 18 and through stem 11.

The novel cap 18 of the present invention has an elongated groove 26 in the upper surface thereof which matches an elongated protuberance 27. Thus, when stem 11 is screwed into the threaded central passageway 21 of cap 18, it secures the cap portion 23 against the cap and protuberance 27 drops into groove 26 to cause the two parts to turn together. While a groove in a protuberance is shown in the drawings, any sort of indexing surface irregularity can be used.

Figure 3:
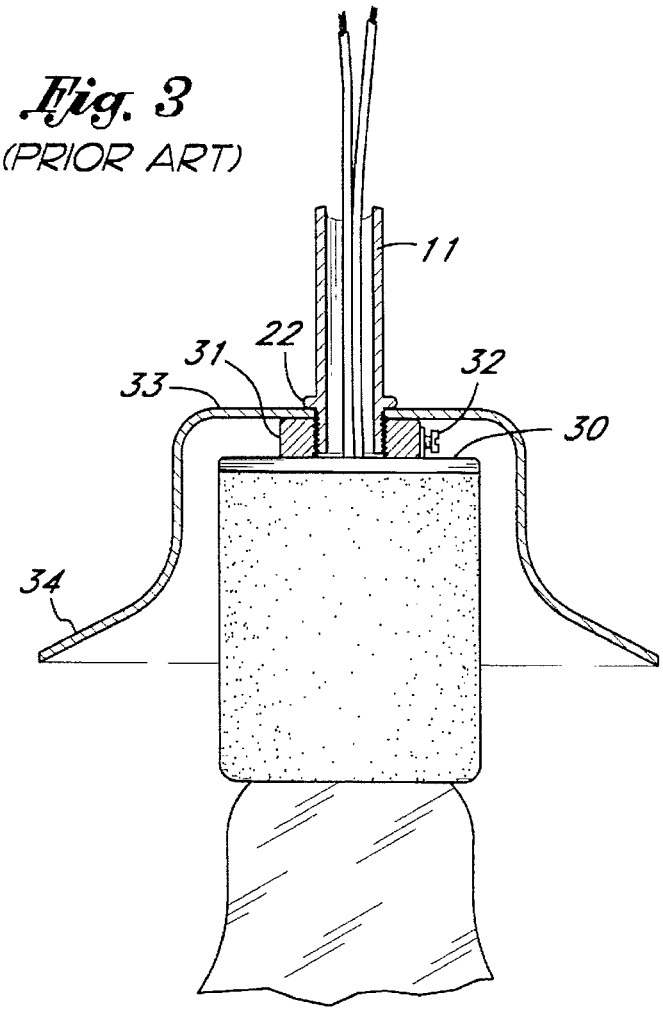
Fig. 3 (PRIOR ART)
FIG. 3 is a cross sectional view of a prior art assembly.

A prior art cap is shown in FIG. 3 and indicated generally by reference character 30. Cap 30 has an extension 31 which has an internal thread and which also holds a set screw 32. However, with most visible downwardly depending fixtures, there is no way of tightening set screw 32. It is also undesirable to use a lock washer between flange 22 and the cap portion 33 of reflector 34 of FIG. 3. A lock washer is unsightly and also will scratch the upper surface which in turn leads to corrosion and an unsightly appearing fixture.

The intermeshing of the protuberance and the groove of the assembly of the present invention is shown in cross sectional view in FIG. 4. It also shows that the husk 14 is held to cap 18 by a pair of upwardly directed screws 35. These may be somewhat longer than the conventional screws since the screw holes 36 extend to the bottom of groove 26 rather than merely through the thin disk shaped portion of the prior art cap 30.

Figure 5:
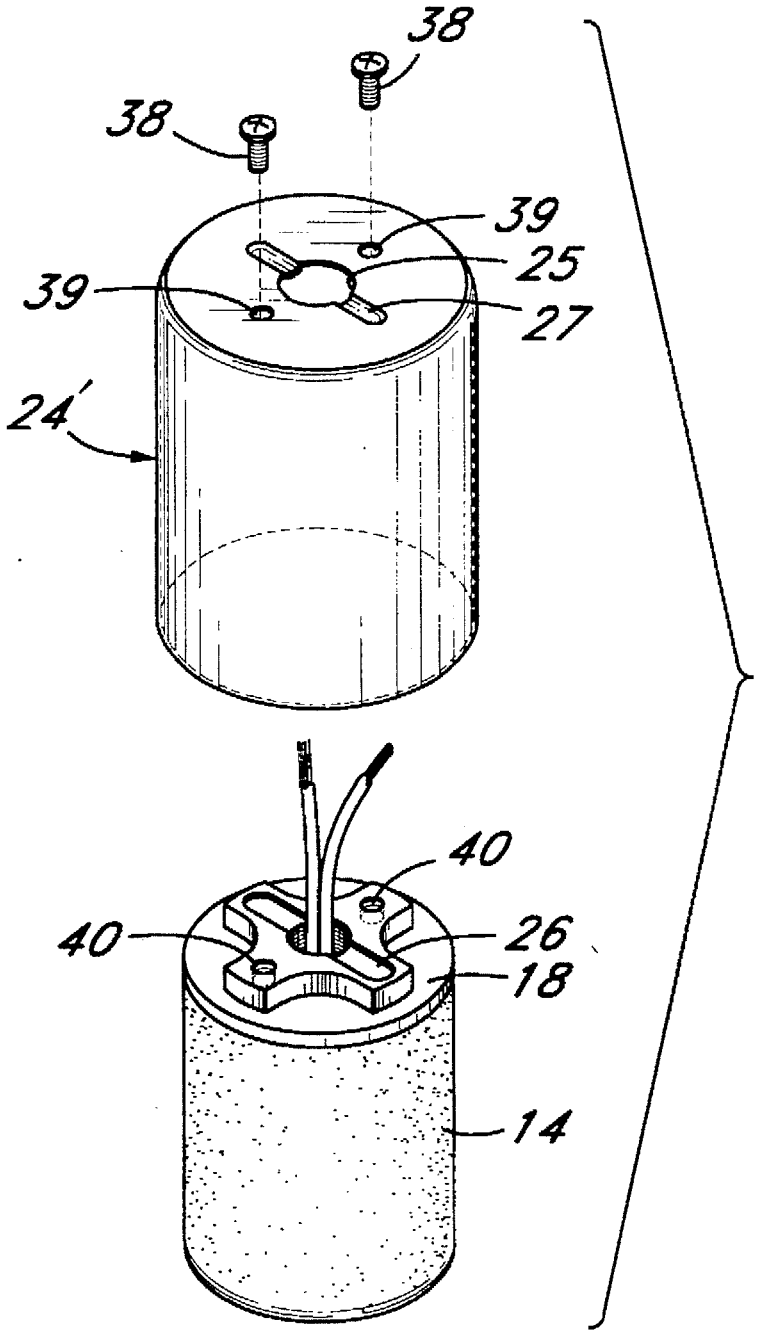
FIG. 5 is an exploded perspective view of an alternate embodiment of the assembly of FIG. 2, excluding the stem.

An alternate embodiment of the assembly of FIG. 1 is shown in exploded view in FIG. 5. There a pair of screws 38 fit through a pair of holes 39 into threaded blind openings 40 on the top of cap 18. Openings do not pass through cap 18 so that screws cannot be passed downwardly to make an electrical contact. In many applications the screws 38 will be undesirable because of asthetics. Also, with the continued heating and cooling these screws can also work their way loose. The screws do, however, do cooperate with a groove to provide an exceptionally secure assembly which facilitates the tightening of stem 11 thereon.

The result is a lamp socket assembly which is far safer than conventional assemblies. The heating and cooling cycles through which the assembly goes will still cause a certain amount of loosening, but this can be easily tightened by merely grasping cup 24 and stem 11. Then cup 24 is turned, cap 18 is also turned, thereby tightening stem 11 against cup 24 and preventing any further loosening. It is also beneficial that a set screw opening be included for installations where a set screw can be used.

The cap 18 is formed out of the conventional materials for a cap and may be readily cast with elongated groove or other indexing surface irregularity therein. Cup 24 may likewise be formed with a matching indexing surface irregularity and neither part costs any significant amount more than the conventional part. The result, however, is a far safer design than conventionally available.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A lamp socket assembly of the type having an insulative husk having a cylindrical outer surface, a top surface and an internal conductive lamp holding shell and two leads connected to the conductive lamp holding shell and extending upwardly from the top surface, wherein the improvement comprises:

a cap affixed above the top surface of the insulative husk, said cap having an indexing surface irregularity and said cap having a threaded central passageway for the passage of said two leads and for the affixing of a stem;

a cover member having a cap portion having a matching indexing surface irregularity to that of said cap, said cover member extending downwardly over said husk and said cover member also having a threaded central opening for the passage of a stem and the leads therein; and a stem having a hollow portion and a threaded internal end with a threaded length extending inwardly from said threaded end and said stem having an external end and a flange near the internal end thereof adjacent said threaded length and said flange abutting said cap and being positioned so that when said threaded internal end is tightened into said threaded central opening of said cover member, said flange forces the surface irregularity of the cap against the surface irregularity of the cover member, whereby when the cover is placed over the cap, the indexing surface irregularity on the cap is matched against the indexing surface irregularity of the cover member and the stem is tightened into the cap so that the flange thereof abuts the cap portion of the cover member, the cover member is prevented from turning with respect to the husk and cap.

2. The lamp socket assembly of claim 1 wherein the indexing surface irregularity of said cap is an elongated groove extending in both directions from the threaded central passageway and the indexing surface irregularity of the cover member is an elongated downwardly directed protuberance.

3. The lamp socket assembly of claim 2 wherein said cap has an elevated cross having two crossing arms each arm having an upper surface and said elongated groove is formed on an upper surface of one of said crossing arms.

4. The lamp socket assembly of claim 3 wherein the other of said crossing arms contains a pair of threaded openings.

5. A lamp socket assembly of the type having an insulative husk having a cylindrical outer surface, a top surface and an internal conductive lamp holding shell and two leads connected to the conductive lamp holding shell and extending upwardly from the top surface, wherein the improvement comprises:

a cap affixed above the top surface of the insulative husk, said cap having an upwardly extending cross having first and second crossing arms, each of said crossing arms having a generally flat surface and having an indexing surface irregularity positioned along the upper surface of one of said crossing arms and said cap having a threaded central passageway at an intersection of said first and second crossing arms for the passage of said two leads and for the affixing of a stem;

a cover member having a cap portion having a matching indexing surface irregularity to that of said cap, said cover member extending downwardly over said husk and said cover member also having a central opening for the passage of a stem and the leads therein;

a stem having a hollow portion and a threaded end with an external end and an internal end and a flange adjacent the internal end thereof, whereby when the cover member is placed over the cap, the indexing surface irregularity on the cap is matched against the indexing surface irregularity of the cover member and the stem is tightened into the cap so that the flange thereof abuts the cap portion of the cover member the cover member is prevented from turning with respect to the husk and cap.

6. The lamp socket assembly of claim 5 wherein the indexing surface irregularity on said cap comprises a groove.

7. The lamp socket assembly of claim 5 wherein said cover member is a cup.

8. The lamp socket assembly of claim 5 further including a set screw opening terminating at said threaded central passageway.

9. The lamp socket assembly of claim 5 wherein said conductive lamp holding shell is held to the husk by a pair of screws which terminate near the ends of one of the crossing arms.

* * * * *